United States Patent [19]

Haines

[11] 4,340,226

[45] Jul. 20, 1982

[54] GAMES RACKET

[75] Inventor: Robert C. Haines, Huddersfield, England

[73] Assignee: Dunlop Limited, London, England

[21] Appl. No.: 177,394

[22] Filed: Aug. 12, 1980

[30] Foreign Application Priority Data

Aug. 24, 1979 [GB] United Kingdom ..... 7929589

[51] Int. Cl.[3] ..... A63B 49/10

[52] U.S. Cl. ..... 273/73 F; 273/73 C; 273/73 J; 273/DIG. 8

[58] Field of Search ..... 273/73 R, 73 C, 73 D, 273/73 F, 73 G, 73 H, 73 J, 73 K, 72 A, 80 B, 82 R, 82 A, DIG. 1–DIG. 10, 23

[56] References Cited

U.S. PATENT DOCUMENTS

| | | | |
|---|---|---|---|
| 3,265,401 | 8/1966 | Spier | 273/80 B X |
| 3,801,098 | 4/1974 | Gildemeister | 273/72 A |
| 3,810,620 | 5/1974 | Decker et al. | 273/73 J X |
| 3,986,716 | 10/1976 | Taussig et al. | 273/73 D X |
| 3,990,701 | 11/1976 | Kim | 273/73 K X |
| 4,025,377 | 5/1977 | Tanikawa | 273/72 A X |
| 4,099,718 | 7/1978 | Marks | 273/73 C |
| 4,119,313 | 10/1978 | Popplewell | 273/73 C X |
| 4,177,990 | 12/1979 | Kajiwara | 273/73 F X |
| 4,181,301 | 1/1980 | Serpoud et al. | 273/73 F X |
| 4,194,738 | 3/1980 | Inoue et al. | 273/73 C |

FOREIGN PATENT DOCUMENTS

| | | | |
|---|---|---|---|
| 1942082 | 3/1971 | Fed. Rep. of Germany | 273/73 F |
| 54-12930 | 1/1979 | Japan | 273/73 F |

*Primary Examiner*—Richard J. Apley

*Attorney, Agent, or Firm*—Stevens, Davis, Miller & Mosher

[57] ABSTRACT

A hollow injection moulded thermoplastics games racket frame comprising a head (21) and a shaft (20), the head (21) having integrally-formed internal supports (25) containing the stringing holes (23) and the moulding being polyurethane foam-filled. The foam filling is provided in two parts, a lighter filling (32) for the head and a denser filling (33) for the shaft. The shaft filling (33) is integrally-formed with a foam handle portion (34). The handle end of the shaft is preferably provided with moulded-in holes (31) through which filling (33) can flow during its foaming.

13 Claims, 13 Drawing Figures

GAMES RACKET

Figure 1:
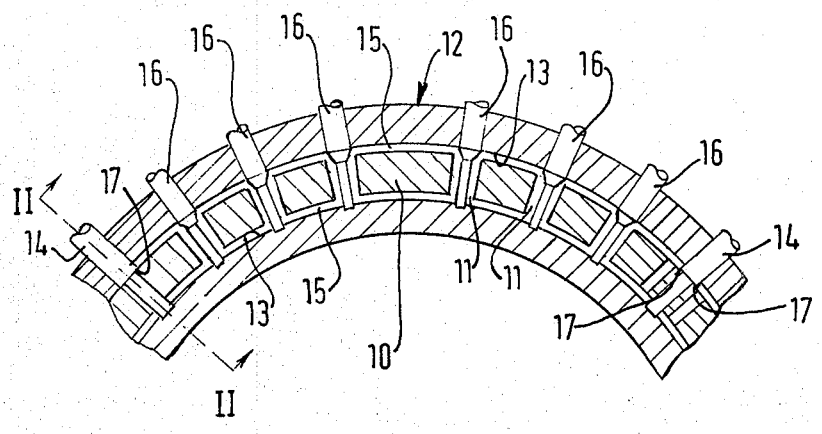

This invention relates to rackets for use in games, for example, tennis, squash and badminton, and is particularly concerned with the construction of the frames of these rackets.

A recent development in the manufacture of racket frames is described in our British patent application No. 7,906,533 (Ser. No. 2,015,886) and our equivalent Belgian Pat. No. 874,678, which describe a games racket frame comprising a head and a shaft, at least the head being a hollow injection moulding of thermoplastics material reinforced with short filament reinforcing material, as defined below, and in which the wall of the moulding which lies at the outer circumference of the head is joined to the wall which lies at the inner circumference of the head by an internal support means and the stringing holes in the head pass through the support means, the walls and support means of the moulding being integrally-formed. There is also described a method of making a frame for such a games racket, in which at least the head is formed by injecting a thermoplastics material around a fusible core, the core having a melting point below the injection temperature and being shaped to provide internal support means between that wall of the moulding that is to lie at the outer circumference of the head and that wall of the moulding that is to lie at the inner circumference of the head, allowing the moulding to set and then raising the temperature to an amount sufficient to melt the core but insufficient to melt or deform the moulding.

By "short filament reinforcing material" here is meant short discrete lengths of fibre reinforcing material which are randomly dispersed in the thermoplastics matrix, i.e. in contrast tO continuous filament reinforcements which are usually in the form of woven fabric or braid or aligned undirectionally in what is commonly referred to as a 'warp sheet' or 'warp strip.'

The present invention is directed to a development of the racket frame described in the aforesaid application in which the formed, hollow moulded racket frame is given a filling of two different foam materials and an integrally-foamed handle.

Rackets having a frame comprising a hollow plastics material shell filled with a foam core are well known, the foam core providing advantages such as good damping properties. Such rackets have either been proposed by fabricating a resin-impregnated fibre reinforcement around a pre-formed foam core or around a foam cure precursor and setting the resin while, where appropriate, foaming the core or by making the hollow reinforced shell and then putting a foam precursor inside the shell and allowing it to foam. See for example British Pat. Nos. 1,469,039 and 1,527,488 and our aforesaid British patent application and equivalent Belgian patent.

We have now found that a combination of an injection moulding technique to provide the hollow shell of the frame followed by two foam-forming operations to fill the hollow frame, the latter foam-forming operation also being used to integrally-form a handle for the frame, can provide a very good racket frame by a very efficient manufacturing process.

Accordingly the present invention provides a games racket frame in the form of a hollow injection moulding of reinforced thermoplastics material, in which the frame comprises a head and a shaft, the wall of the moulding which lies at the outer circumference of the head is joined to the wall which lies at the inner circumference of the head by an internal support means and the stringing holes in the head pass through the support means, and the walls and support means of the moulding are integrally-formed, in which the hollow head of the frame has a filling of polyurethane foam of density from 0.10 to 0.25 g/c.c. and the hollow shaft has a filling of rigid polyurethane foam of density from 0.30 to 0.50 g/c.c., the rigid polyurethane foam of the filling being integrally-formed with a rigid foam handle portion encasing the handle end of the shaft, and in which the two foam fillings meet at, or on the head side, of the handle.

The invention also provides a games racket incorporating a frame according to the immediately preceding paragraph.

The head filling may be of flexible or rigid polyurethane foam (the latter being preferred) and may extend, if desired, partway along the shaft up to a limit of the commencement of the handle portion of the shaft.

The invention provides a convenient and advantageous way of obtaining racket frames having particular weight and balance properties. Thus it will be appreciated that the use of two foam fillings of different densities enables racket frames to be fabricated having a relatively wide range of balance characteristics at any given weight. At the same time the integral formation of the foam handles is a very convenient and economical method of providing a frame ready for the normal finishing operations, e.g. polishing, marking and the like, and stringing. The handle may be covered by any suitable means, e.g. a leather or towelling strip which can be adhered and/or pinned to the handle portion.

It may be found convenient to use the same polyurethane foam formulatIon for the head filling and for the shaft filling. The required difference in final foam density can then be readily achieved by an appropriate calculation based on the weight of foam precursors used and the volume to be filled.

Preferred polyurethane foams to be used in the invention are obtained from the reaction of a diisocyanate, e.g. methylene diisocyanate or tolylene diisocyanate, with a polyol, e.g. propylene glycol. The desired densities of the final foam fillings may be achieved, for example, by using quantities of precursors that would give a lighter than desired density if allowed to rise freely rather than being constrained within the volume of the hollow moulded frame. Thus, for example, the foam used for the head filling may have a free-rise density of 0.03 to 0.04 g/c.c. and the foam used for the shaft filling may have a free-rise density of 0.20 to 0.22 g/c.c. By accurate metering of the precursors and by constraining the foam, as it is generated, within certain volumetric limits it is possible to achieve substantially uniform foam quality without significant voids.

The foam fillings can readily be made in-situ inside the hollow moulded frame as follows. The requisite amount of the light foam precursors are dispensed into the frame through the open end of the shaft. The frame may conveniently be held vertically with the head lowermost. A plunger is then inserted along the shaft as far as the calculated position necessary to give the desired foam density based on the volume and weight consideration referred to above. After the chemical reaction has proceeded and the foam has filled the head of the frame as far as the plunger and has sufficiently set, the handle end of the racket is then inserted in a mould having the configuration and dimensions of the desired handle. The requisite amount of the denser foam precursors are dispensed in the mould and foam to fill the shaft up to the point where the lighter foam ends and also to form the required handle portion. The handle portion of the shaft is preferably provided with moulded-in holes to ensure full and free foaming of the precursors so that the inside of the shaft and the outside portion corresponding to the mould cavity are completely and integrally foamed.

The hollow moulded frame used in this invention preferably has the preferred features of the frame disclosed in our Application No. 7,906,533 (Ser. No. 2,015,886). Thus the internal support means is preferably a row of centrally-disposed hollow pillars, the row extending around the head portion of the frame. The axis of each pillar preferably lies in the plane of the strings of the racket and preferably is normal to the tangent to the circumference of the head at that point.

However, if desired, the axes of the pillars could lie at angles other than normal to that tangent and could for example, be aligned with the direction of the strings. The pillars are hollow so that each can provide a hole running from the outer circumference to the inner circumference of the head of the frame. The holes through the pillars thus conveniently provide the stringing holes for the frame. (With this construction, the presence of the pillars surrounding the holes means that the hollow frame can be foam-filled without the foam escaping through the stringing holes).

In an alternative embodiment, each pillar may be in the form of an abutment from one or other of the sidewalls of the moulding, and preferably alternate pillars project from opposite walls. By sidewalls is meant those portions of the frame wall that constitute one or the other of the two visible faces of the racket when it is viewed from the front or rear at right angles to the plane of the strings.

The transverse sectional shape of the frame may be any desired shape, for example circular, oval or rectangular. The latter is preferred as its box-like section can give very high stiffness and strength to weight ratios. It is found advantageous to form in the outer circumference of the head a longitudinally extending groove or channel to recess the strings of the racket and safeguard them from abrasion. The transverse sectional shapes referred to immediately above, therefore, include those shapes when such a groove or channel is incorporated.

Suitable thermoplastic materials from which the frame may be moulded include polyamides, polycarbonate, acrylonitrile-butadiene-styrene (ABS), acetal resins and poly(phenylene oxide) (PPO). (So-called 'modified' grades of PPO are now commercially available that are especially designed for injection-moulding applications).

The plastics material used is preferably reinforced with glass fibres or carbon fibres. Carbon fibres are the preferred reinforcing means and injection mixtures containing from 10% to 40% by weight of carbon fibre are especially preferred. Mixtures of glass and carbon fibres may also be used.

The wall thickness of the hollow frame of the invention need not be the same throughout and in fact the ability to vary the thickness may be a useful advantage. Zones of greater or lesser thickness may be utilised in order to optimise the required strength/weight and balance characteristics. For example, the wall thickness may be increased in the shoulder areas of the frame where considerable stress arises in use or similarly the thickness may be increased at the top of the head loop to improve impact-resistance.

However, a better way of varying these characteristics around the frame is to vary the section of the frame rather than the wall thickness, particularly as there will be advantages in the moulding process and in the later annealing stages if the moulding has a substantially uniform wall thickness.

The actual dimensions of the hollow section used will depend of course on the type of racket, e.g. whether for tennis, squash or badminton, and similarly the wall thickness will be governed by strength and weight requirements for the particular game. The average skilled man of the art will readily be able to decide suitable dimensions for his particular requirements. As an example only, a useful wall thickness may be 2 mm.

Figure 2:
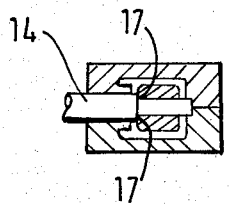
Figure 4:
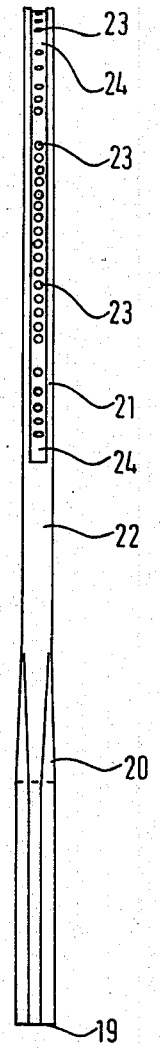
Figure 3:
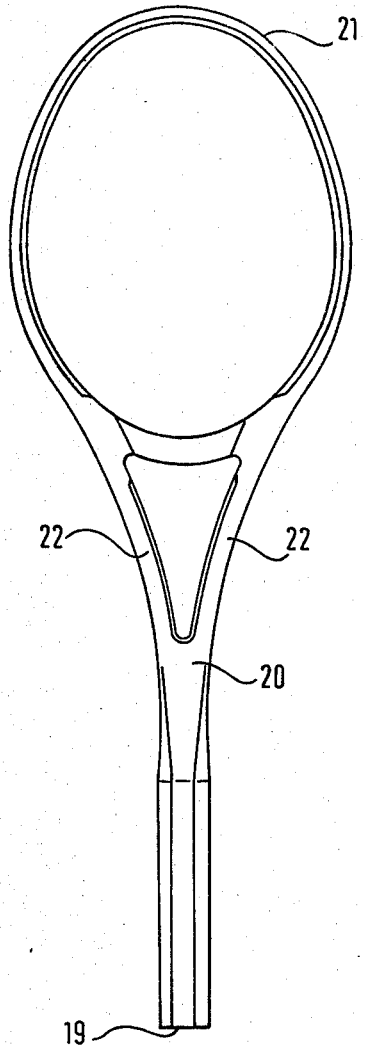
Figure 5:
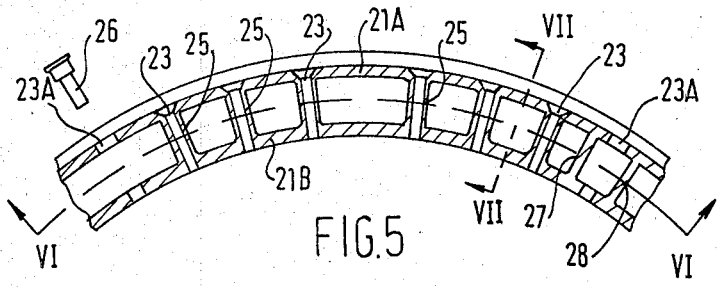
Figure 6:
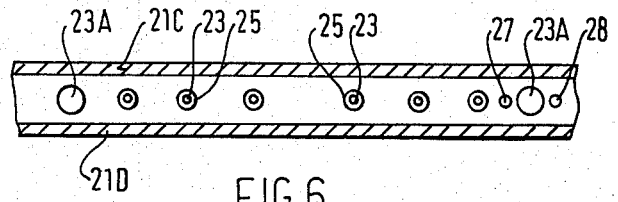
Figure 7:
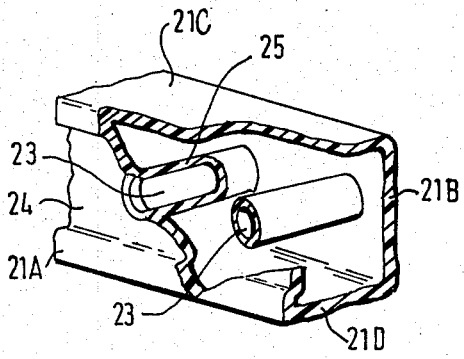
Figure 9:
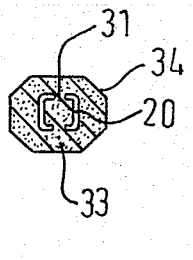
Figure 8:
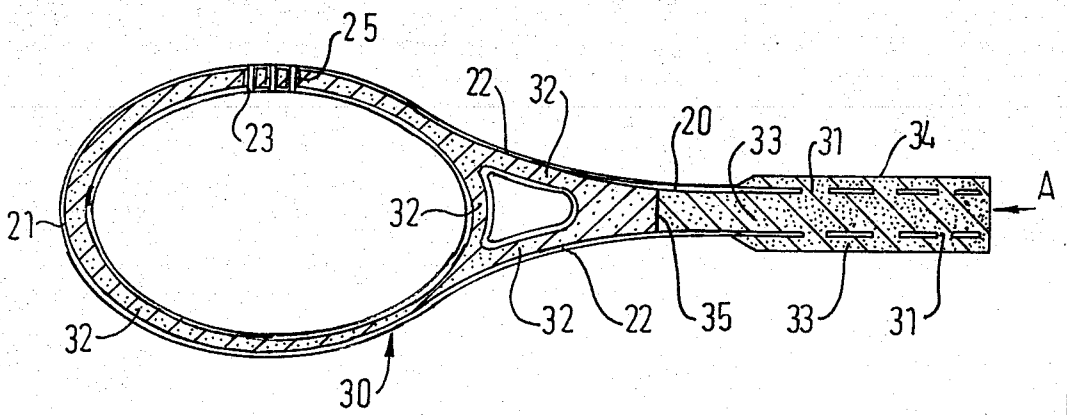

The invention is further described with reference to the accompanying drawings in which:

FIG. 1 is a vertical section through a portion of an injection mould containing a metal core for a racket frame, FIG. 2 is a section along line II—II of FIG. 1, FIG. 3 is an elevation of a moulded racket frame, FIG. 4 is a side view of the frame of FIG. 3, FIG. 5 is a vertical section through a portion of the frame of FIG. 3, FIG. 6 is a section along line VI—VI of FIG. 5, FIG. 7 is a sectional view with parts cut away along line VII—VII of FIG. 5, FIG. 8 is a section in the stringing plane of a racket of the invention but with internal reinforcements not shown for clarity, FIG. 9 is a view of the handle end of the racket in the direction of arrow A of FIG. 8, and FIGS. 10 to 13 are diagrammatic representations illustrating four steps in the foam-forming stage in the manufacture of a racket of the invention.

FIGS. 1 to 7 illustrate the manufacture of the hollow shell of an injection-moulded racket frame which can then be foam-filled to form a frame of the invention.

FIG. 1 for convenience illustrates that portion only of a mould core and injection mould that corresponds to the crown or top portion of a racket frame.

A core 10 of fusible metal (e.g. Cerrocast, available from Mining and Chemical Products Limited, Birmingham) is made by die-casting. It has the desired loop shape of the racket head and may also, if desired, extend to include a portion corresponding to the shaft of the racket. It is formed with a series of holes 11 running through the head portion transverse to the loop, these corresponding to the desired positions of the stringing holes of the racket frame.

The core 10 is positioned inside a suitably-dimensioned and shaped injection mould 12 and is held in the required position in the moulding chamber 13 by retractable locating pins 14. A gap 15 is thereby left surrounding the core and between it and the walls of the chamber 13, the gap corresponding to the desired walls of the frame moulding. A pin passes through each hole in the core. The majority of the pins 16 are of diameter less than that of the holes in the core whereby the walls of the supporting pillars of the eventual frame can be formed. Every few cms along the core, say 15 cms, a locating pin 14 is used which is of larger diameter and which completely fills its hole in the core. These larger diameter pins are provided with shoulders 17 to abut the core around the hole. The shoulders 17 are positioned to be on the opposite side of the core to the injection ports of the mould (not shown) and thereby firmly hold the core in position against the injection pressure. The injection ports are preferably on the inside of the head loop. These larger diameter pins 14 of course result in pillarless holes of larger diameter than those through the pillars. These larger holes in the product can be subsequently lined with grommets, e.g. of plastics material. The locating pins are preferably positioned adjacent the injection ports of the mould. (It may in fact be found unnecessary to have the locating pins all around the core. Four locating pins, one on each side in the shoulder area and in the crown area may be found to be sufficient).

Fibre-reinforced thermoplastics material (nylon 6,6 incorporating 30% by weight of carbon fibres, for example, which is obtainable from Liquid Nitrogen Processing Corp. of Pennsylvania, U.S.A. under their reference RC-1006) is then injected into the mould and allowed to set.

The pins 14 and 16 are retracted and the moulding, with its core, is removed from the mould.

A number of mouldings with their cores are batch-annealed in, for example, a forced-air oven. The temperature of annealing is sufficient to melt the metal cores and the molten metal runs out of appropriately-positioned holes in the mouldings into suitably placed containers. For example suitable drain holes could conveniently be provided, where head and shaft portions are integrally-formed, by designing the mould to leave open the end 19 of the shaft 20 remote from the head 21 (see FIGS. 3 and 4). The mouldings can then be annealed while hanging with end 19 lowermost. Thus the heating step to melt the core can very conveniently be combined with an annealing step which may be desirable to remove internal strains from the moulding.

One form of possible moulded frame is shown in FIGS. 3 to 6. It has a head loop 21 for stringing and arms 22 joining the head to a shaft 20. Head loop 21 has stringing holes 23 in a recessed groove 24 running around its outer circumference.

As will be seen from the sectional views of FIGS. 5, 6 and 7, the frame is of a hollow, box-like construction having outer wall 21A, inner wall 21B (i.e. with respect to the head loop) and sidewalls 21C and 21D. Hollow pillars 25 define the stringing holes 23 and provide support between outer wall 21A and inner wall 21B. Pillars 25 and holes 23 correspond to the positions of pins 16 of the core 10 of FIG. 1. Larger diameter stringing holes 23A correspond to the positions of locating pins 14 of the core 10 of FIG. 1. The construction of FIG. 5 is also shown with solid pillars 27 and 28, one on each side of larger hole 23A. These solid pillars are an optional feature to add reinforcement to the frame section near to the larger holes. They are formed by the use of corresponding holes (not shown) in core 10 without pins. The larger holes 23A are conveniently lined with grommets such as that shown at 26.

The annealed hollow frame made as described above may then be foam-filled as described below with reference to FIGS. 10 to 13.

Views of a foam-filled frame with integrally-formed foam handle are shown in FIGS. 8 and 9. For the sake of clarity the majority of the internal reinforcements such as 25, 27 and 28 of FIG. 5 are not shown and only three reinforcements with their associated stringing holes 23 are shown.

Racket frame 30 is in the form of a hollow injection moulded shell having, as before, a head loop 21 and arms 22 joining the head to a shaft 20. Head loop 21 has stringing holes 23 through internal reinforcements 25. The handle end of shaft 20 has holes 31 drilled or moulded in it.

Head 21, arms 22 and a head-end portion of shaft 20 are filled with a relatively light polyurethane foam 32 which surrounds the internal reinforcements. The remainder of shaft 20 is filled with a relatively denser polyurethane foam 33. Foam 33 extends through holes 31 to form an integral handle 34. Foams 32 and 33 meet at boundary line 35 in shaft 20.

FIGS. 10 to 13 illustrate one way of achieving the foam filling with integral handle and are described with reference to the following example.

EXAMPLE

Figures 10, 11, 12, 13:
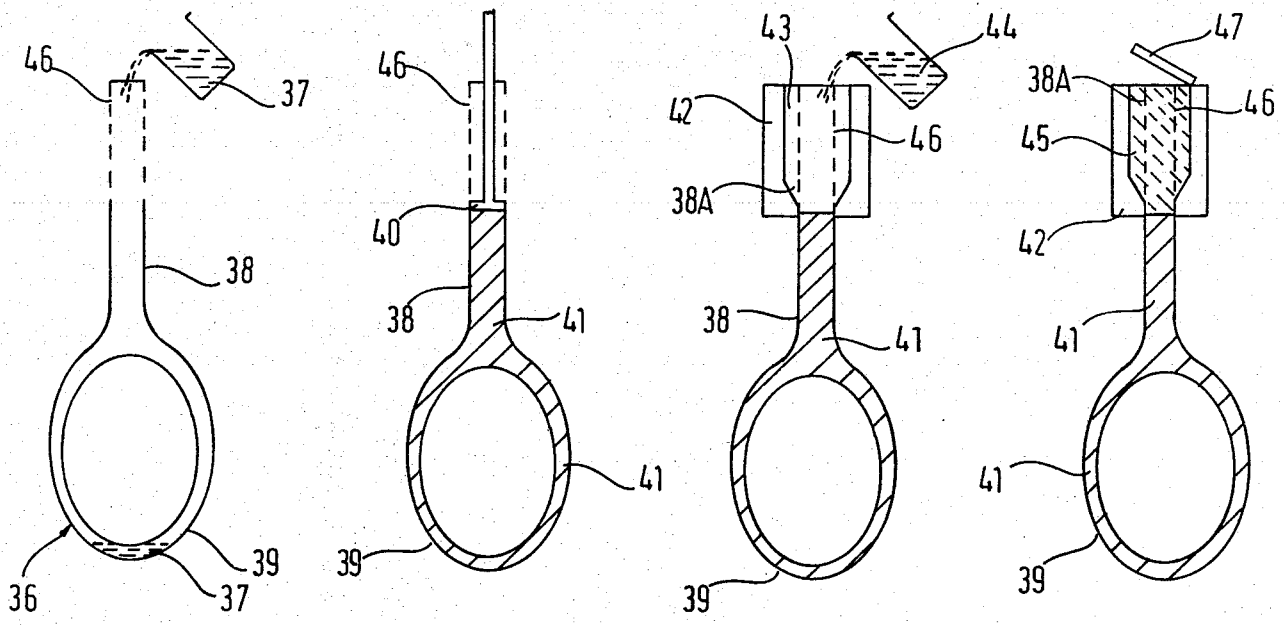

A hollow frame 36 was made by injection moulding from nylon 6.6 reinforced with 30% by weight of carbon fibres using the fusible core technique described above. The frame was found to weigh 252 grm. Polyurethane precursors which produce a rigid foam of free rise density of 0.035 gm/c.c. were mixed together and 25 gms. of the mixture 37 were poured down the shaft 38 of the frame and into the hollow head region 39 (FIG. 10). The volume into which the foam was allowed to expand was restricted by introducing a barrier in the form of a removable plug 40 in the desired position in the hollow shaft of the frame (FIG. 11). After about 10 minutes the plug was removed and the foam 41 found to be set. The handle end 38A of the shaft 38 was then introduced into a mould 42 which was arranged around the shaft in such a way as to define a cavity 43 having the shape of the required handle (FIG. 12). Polyurethane precursors which produce a rigid foam of free rise density 0.21 gm/cc were mixed together and 60 gms. of the mixture 44 poured down the shaft of the frame. This mixture foamed and the lid 47 of the mould was closed so that the foam 45 expanded through the holes 46 moulded in the handle end of the shaft of the frame and so filled the void remaining inside the shaft, i.e. up to the position of the foam 41 of lower density already in-situ, and also filled the cavity 43 defined by the mould surface (FIG. 13), thereby forming an integral foam handle.

After 10 minutes the frame was removed from the handle mould and excess material trimmed away.

The frame was then painted and decorated and the handle completed by wrapping with a leather grip as is accepted practice. The frame was then strung with natural gut at a tension of 58 lbs.

The strung frame in finished form was found to weigh 380 gms and was found to balance at a position 327 mms from the extreme handle end.

A metered dispenser may of course be used to supply the foam precursors to the hollow racket frames.

By varying the weight of the polyurethane precursors used for filling both the head and the lower shaft/handle area the weight and balance of frames can be significantly changed. It has been found that the weight and balance of frames can be varied between limits acceptacle to players, e.g.

| Weight (gms) | Balance for strung racket point measured from extreme end of handle (mms) |
|---|---|
| 360 | 338 |
| 370 | 333 |
| 380 | 327 |
| 390 | 324 |
| 400 | 319 |

Having now described my invention, what I claim is:

1. A games racket comprising:

A head and a shaft, the head being of hollow tubular cross section over a majority of its perimeter, the shaft having a hollow tubular cross section in communication with the hollow tubular cross section of the head so that both said hollow tubular cross sections may be filled with foam material injected from the distal end of said shaft, a first foam material of polyurethane foam of density from 0.10 to 0.25 g/c.c., filling at least the hollow cross section of said head, a second foam material of rigid polyurethane foam of density from 0.30 to 0.50 g/c.c., filling the entire remaining hollow portion of said shaft from an interface with said first foam, said second foam material also covering the outer surface of the shaft adjacent the distal end thereof so as to form a handle thereon of a larger diameter than said shaft which is integral with the second foam material inside said hollow cross section of said shaft.

2. A games racket frame according to claim 1 in which said filling of the head is of rigid foam.

3. A games racket frame according to claim 2, in which said head filling and said shaft filling are of substantially the same polyurethane foam formulation.

4. A games racket frame according to claim 1, 2 or 3, in which said polyurethane foam is a reaction product of a polyol with methylene diisocyanate or tolylene diisocyanate.

5. A games racket frame according to claim 1, 2 or 3, in which the foam used for said head filling has a free-rise density of 0.03 to 0.04 g/c.c.

6. A games racket frame according to claim 1, 2 or 3, in which the foam used for said shaft filling has a free-rise density of 0.20 to 0.22 g/c.c.

7. A games racket frame according to claim 1, 2 or 3, in which said handle portion of the shaft has holes through which the shaft foam filling can flow during its foaming.

8. A games racket frame according to claim 7, in which said holes are integrally moulded in the shaft of the frame.

9. A games racket frame according to any one of claims 1, 2, 3 or 8, in which said internal support means is a row of centrally-disposed pillars, the row extending around the head portion of the frame.

10. A games racket frame according to claim 7 or 8, in which said handle is integrally-formed with the shaft through the holes in the shaft.

11. A games racket frame according to claim 1, in which said handle is also integrally-formed with the shaft by surrounding the distal end thereof.

12. A games racket frame according to claim 1, in which said handle is integrally-formed with the shaft by surrounding the distal end thereof.

13. A games racket frame according to claim 1, in which said head has stringing holes, the wall of said head which lies at the outer perimeter of said head is joined to the wall which lies at the inner perimeter of said head by an internal support means, and said stringing holes pass through said support means, and said walls and support means of the head are integrally-formed.

* * * * *